US009121190B1

(12) United States Patent
Douglas

(10) Patent No.: US 9,121,190 B1
(45) Date of Patent: Sep. 1, 2015

(54) ANIMAL RESCUE STEP FOR A SWIMMING POOL

(71) Applicant: Glen R. Douglas, Bridgeport, CT (US)

(72) Inventor: Glen R. Douglas, Bridgeport, CT (US)

( * ) Notice: Subject to any disclaimer, the term of this patent is extended or adjusted under 35 U.S.C. 154(b) by 169 days.

(21) Appl. No.: 13/864,455

(22) Filed: Apr. 17, 2013

Related U.S. Application Data

(60) Provisional application No. 61/637,086, filed on Apr. 23, 2012.

(51) Int. Cl.
*E04H 4/00* (2006.01)
*E04H 4/14* (2006.01)

(52) U.S. Cl.
CPC ..... *E04H 4/144* (2013.01)

(58) Field of Classification Search
CPC ..... E04H 4/14; E04H 4/144; A01K 1/035; A01K 1/00; A01K 29/00
USPC ..... 119/849, 246; 4/488, 496, 504; 441/129; 114/362; 52/182–191, 741.2
See application file for complete search history.

(56) References Cited

U.S. PATENT DOCUMENTS

| | | | | |
|---|---|---|---|---|
| 4,972,540 | A | 11/1990 | Phelps | 14/75 |
| 5,213,060 | A | 5/1993 | Sloan et al. | 119/82 |
| 5,320,568 | A * | 6/1994 | Koerkel, Jr. | 441/129 |
| 5,377,623 | A | 1/1995 | Parr | 119/221 |
| 5,862,541 | A | 1/1999 | Mailhot | 4/496 |
| 6,598,562 | B1 * | 7/2003 | Dutkiewicz et al. | 119/706 |
| 7,011,045 | B1 | 3/2006 | Zehner | 119/673 |
| 7,735,457 | B2 * | 6/2010 | O'Connor | 119/849 |
| 2004/0244724 | A1 | 12/2004 | Runge | 119/847 |

OTHER PUBLICATIONS

Original Froglog. Official Froglog Store. Accessed Nov. 24, 2014. Available Feb. 13, 2006. http://web.archive.org/web/20060213122320/http://www.froglog.us/.*

Current Froglog. Official Froglog Store. Accessed Nov. 24, 2014. Available Apr. 29, 2011. http://web.archive.org/web/20110429015946/http://www.froglog.us/.*

* cited by examiner

*Primary Examiner* — Paul R Durand
*Assistant Examiner* — Nicholas Ros
(74) *Attorney, Agent, or Firm* — Fattibene and Fattibene LLC; Paul A. Fattibene

(57) ABSTRACT

A floating step placed adjacent a side of a swimming pool having a flap on one end for attaching to the side of the swimming pool and a landing or platform. The animal rescue step has a foam core covered by a waterproof fabric and floats adjacent to the side of the swimming pool. The flap has a hole there in used to attached the floating step adjacent the side of the swimming pool. The lowermost step has an attached landing or platform that has a run greater than that of a step and when positioned in the swimming pool is covered with water. A small animal may swim onto the landing and easily climb the steps out of the swimming pool.

4 Claims, 2 Drawing Sheets

ANIMAL RESCUE STEP FOR A SWIMMING POOL

RELATED APPLICATION

This application claims the benefit of U.S. Provisional Application No. 61/637,086 filed Apr. 23, 2012.

FIELD OF THE INVENTION

The present invention relates in general to providing a means of animal egress from a swimming pool, and particularly to a floating step attached to the side of the swimming pool.

BACKGROUND OF THE INVENTION

Often small animals are attracted to water. In swimming pool having relatively high sides, a small animal may easily fall into the swimming pool and be unable to climb out. If no one is around to notice the small animal struggling in the pool, the animal likely will tire and eventually drown.

There have been efforts to provide a device that will permit a small animal to safely climb out of a swimming pool. One such device is disclosed in U.S. Pat. No. 4,972,540 issuing to Phelps on Nov. 27, 1990 and entitled "Swimming Pool Escape System for Animals and Insects". Therein disclosed is a swimming pool escape ramp that is pivotably coupled to a base member and is buoyantly supported to allow the animal to egress from the body of water and climb out of the swimming pool. Another device is disclosed in U.S. Pat. No. 5,377,623 issuing to Parr on Jan. 3, 1995 and entitled "Method and Apparatus for Rescuing Frogs from a Swimming Pool". Therein disclosed is a device for supporting a frog in a swimming pool. A pad with a convex top surface that extends slightly below the waterline is placed in the swimming pool so the frog may climb on the pad. The pad attaches to a ladder with a snap on C-shaped clamp arranged to support the device at the waterline. Another device is disclosed in U.S. Pat. No. 7,011,045 issuing to Zehner on Mar. 14, 2006 and entitled "Pat Ramp". Therein disclosed is a horizontal platform with a sloping ramp that extends into the water of a swimming pool. The ramp has traction enhancing ribs.

While these devices have greatly aided in small animals being able to climb out of a swimming pool, often the devices have been difficult for the small animal to climb onto, especially when the device incorporates a ramp at a relatively steep angle. In many instances the small animal may tire and drown before being able to climb up the ramp. This is especially true when the ramp is slippery due to splashing of water or wave action in the swimming pool. Therefore, there is a need for a simple device that can easily be positioned within a swimming pool and permits a small animal to easily navigate or swim onto and provides a secure footing for the animal to climb out of the pool.

SUMMARY OF THE INVENTION

The present invention is a floating step and platform that is attached to the side of a swimming pool and used to provide a means for a small animal to easily climb out of the water and out of the swimming pool. A buoyant material such as foam is covered with a waterproof fabric. The foam takes the shape of a plurality of steps having at the bottom of the steps a landing or platform. Adjacent the upper most step is a flap having a hole therein for attaching the floating step and platform to the side of a swimming pool. The landing platform is larger than the horizontal surface or run of a step. Additionally, the landing platform is positioned so as to be a wash or covered in water when the floating step and platform is positioned and secured at the edge of the swimming pool.

Accordingly it is an object of the present invention to prevent small animals from drowning within a swimming pool.

It is another object of the present invention to provide a floating animal rescue step that is easy for small animals to swim to and step onto.

It is an advantage of the present invention that it floats and has a relatively large landing or platform covered slightly with water when placed in position within the swimming pool.

It is another advantage of the present invention that it is easily attached and removed from the side of a swimming pool.

Is a feature of the present invention that a buoyant foam material is covered with a colorful fabric having a flap that is easily attached to a walkway around a swimming pool.

It is another feature of the present invention that a large landing is provided below the waterline when positioned within the swimming pool so that a small animal can easily swim onto the landing and climb up the step.

These and other objects, advantages, and features will become more readily apparent in view of the following detailed description.

DETAILED DESCRIPTION OF THE PREFERRED EMBODIMENT

Figure 1:
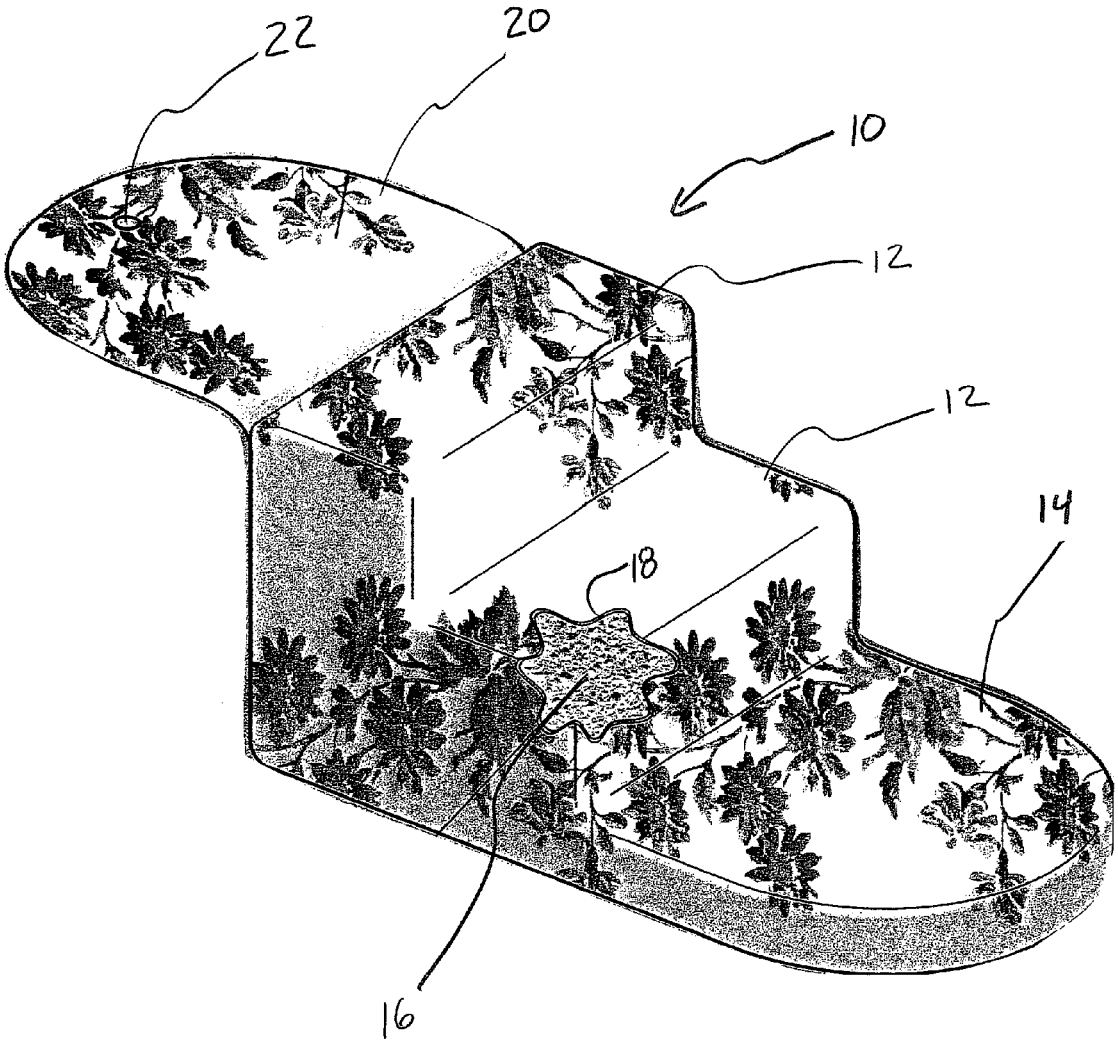
FIG. 1 schematically illustrates the present invention.

FIG. 1 illustrates the present invention. The animal rescue step 10 has a plurality of steps 12. A landing platform 14 is attached to the lowest one of the plurality of steps 12. The plurality of steps 12 and the lending platform 14 are made of a foam core 16 covered by a waterproof covering 18. Attached to the upper most step of the plurality of steps 12 is a flap 20. Formed within the flap 20 is a hole 22 or other means for attaching the animal rescue step 10 to the side of a swimming pool.

Figure 2:
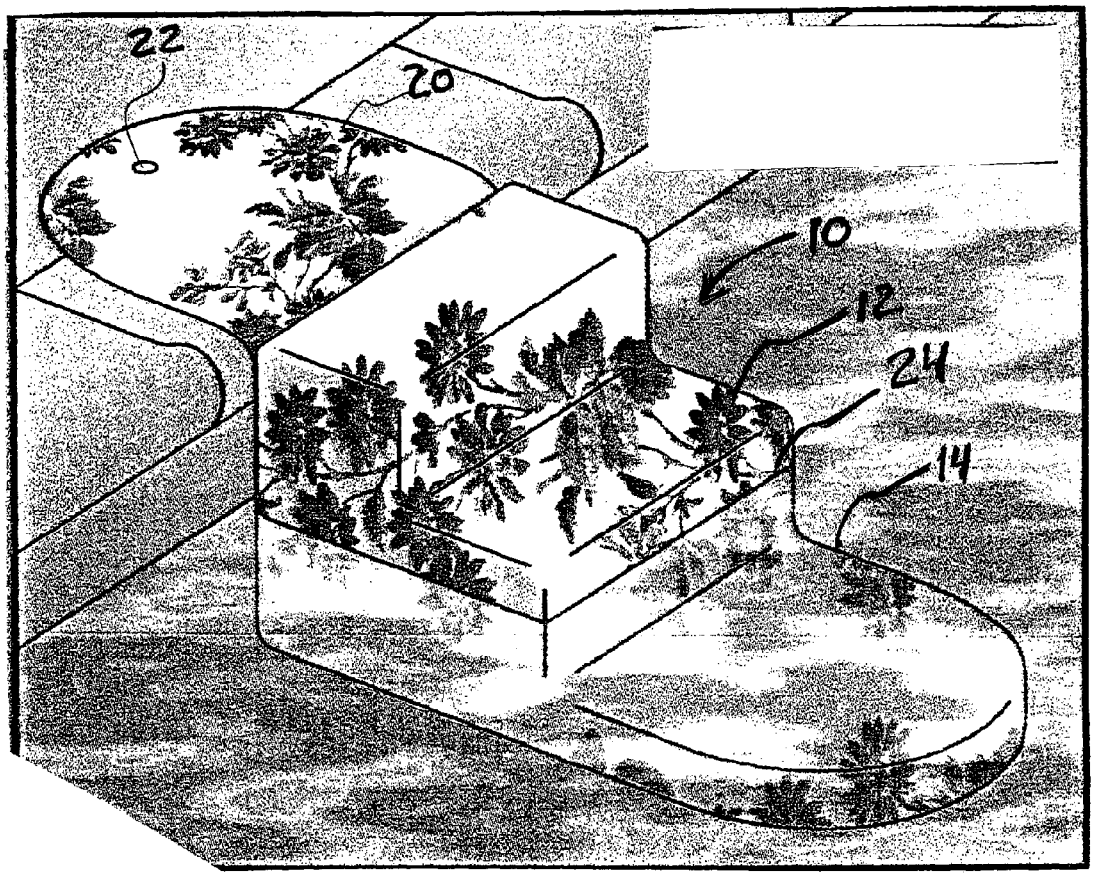
FIG. 2 is a schematically illustrates the present invention in a pool.

FIG. 2 illustrates the animal rescue step 10 placed in a swimming pool and attached to the side of the pool. Flap 20 holds the plurality of steps 12 adjacent to the side of the pool. Flap 20 may be attached to the side of the pool by a hook or pin, or other fastening device placed through hole 22 and attached to the decking of the swimming pool. The means for attaching the flap 20 to the side of the pool may be a hook, pin, fastener, clip, rope, tie, weight, adhesive, or other equivalent structure or device.

The horizontal run of the landing or platform 14 is substantially larger than the horizontal run of one of the plurality of steps 12. The relatively large horizontal run of the lending platform 14 provides a broad stable surface on which an animal may step so as to easily travel up the plurality of steps 12 and escape or egress the swimming pool water.

The animal rescue step 10 may consist of plastic foam steps that measure approximately 6½ inches high and 15 inches long and 15 inches wide. Each step 12 may measure 2 inches tall with a similar horizontal run. The landing platform 14 is 5 inches long, or more than twice the length of the horizontal run of one of the steps 12. These dimensions may vary depending on the size of the swimming pool and size of the small animals intended to be rescued. The animal rescue step 10 may be covered in a decorative waterproof covering 18 and may be made in various sizes and colors.

The animal rescue step 10 of the present invention has many advantages. The present invention helps distressed small animals or a small pet that has fallen into the swimming pool to climb out easily. This will minimize the risk of an animal, or even a family pet from drowning in the swimming pool. The animal rescue step of the present invention is easily attached to the side of the swimming pool and is lightweight and is easily removed for portability or storage. The animal rescue step 10 of the present invention by providing a large horizontal landing or platform that is slightly covered in water permits the small animal to easily swim onto the landing or platform and navigate up the steps out of the swimming pool. The animal rescue step 10 is substantially easier for a small animal to approach and climb up then prior devices having a ramp or other method of egress.

While the present invention has been described with respect to an embodiment, it will be obvious that various modifications may be made without departing from the spirit and scope of this invention.

What is claimed is:

1. A floating animal rescue step for placement in a swimming pool adjacent a pool edge comprising:

a buoyant foam having a shape forming a plurality of rectangular steps, each of the plurality of rectangular steps having a first run;

a landing platform having a second run and a distal curved edge formed within a lowest step of the plurality of rectangular steps of said buoyant foam, the second run of the landing platform being at least twice the first run of each of the plurality of rectangular steps and said landing platform having a rise less than a rise of a next adjacent step of said plurality of steps;

a waterproof fabric covering said buoyant foam;

a flap formed from said fabric covering and extending from an uppermost step;

wherein a side surface of said buoyant foam adjacent said flap comprises a plane surface perpendicular with the uppermost step and extending to a bottom of said landing platform, whereby said side surface may be placed adjacent the pool edge; and a hole in said flap adapted to receive a fastener attached to a side of the swimming pool, whereby the floating animal rescue step is configured to permit animals falling into the pool to easily climb on the curved landing platform and up the plurality of rectangular steps and egress the swimming pool.

2. A floating animal rescue step for placement in a swimming pool as in claim 1 wherein:

said buoyant foam has a buoyancy so that when placed within the swimming pool and floating in water in the swimming pool, said landing platform is covered with the water.

3. A floating animal rescue step for placement in a swimming pool as in claim 2 wherein:

the water does not cover the lowest step.

4. A floating animal rescue step for placement in a swimming pool adjacent a side of the swimming pool having a horizontal surface adjacent an edge comprising:

a buoyant foam core having a shape forming a plurality of rectangular steps, each of the plurality of rectangular steps having a first horizontal run;

a landing platform having a second horizontal run and a distal curved edge formed within a lowest step of the plurality of rectangular steps of said buoyant foam core, the second horizontal run of the landing platform being at least twice the first horizontal run of each of the plurality of rectangular steps;

a waterproof fabric covering said buoyant foam core;

a flap formed from said fabric extending from an uppermost step, wherein the uppermost step and said flap form a continuous horizontal surface from the uppermost step to the horizontal surface adjacent the edge of the swimming pool;

wherein a side surface of said buoyant foam core adjacent said flap comprises a plane surface perpendicular with the uppermost step and extending to a bottom of said landing platform, whereby said side surface may be placed against the side of the swimming pool and adjacent the edge of the swimming pool; and a hole in said flap adapted to receive a fastener attached to the horizontal surface adjacent the edge of the swimming pool, whereby the floating animal rescue step is configured to permit animals falling into the swimming pool with the landing platform placed therein to swim to and step onto so as to easily climb on the curved landing platform and up the plurality of rectangular steps and egress the swimming pool on the continuous horizontal surface formed by said flap and the uppermost step to the horizontal surface of the edge of the swimming pool.

* * * * *